US006427603B1

(12) United States Patent
Martin

(10) Patent No.: US 6,427,603 B1
(45) Date of Patent: Aug. 6, 2002

(54) PIPE RACKING SYSTEM TRACK OVER

(75) Inventor: Therald Martin, Ocean Springs, MS (US)

(73) Assignee: Noble Drilling Corporation, Houston, TX (US)

( * ) Notice: Subject to any disclaimer, the term of this patent is extended or adjusted under 35 U.S.C. 154(b) by 0 days.

(21) Appl. No.: 09/983,575

(22) Filed: Oct. 22, 2001

Related U.S. Application Data

(62) Division of application No. 09/440,629, filed on Nov. 15, 1999, now Pat. No. 6,341,565.

(51) Int. Cl.[7] ..... B61F 13/00
(52) U.S. Cl. ..... 104/139
(58) Field of Search ..... 104/139, 140, 104/141, 142, 145; 191/23 R, 25; 4/498, 500, 502; 238/14

(56) References Cited

U.S. PATENT DOCUMENTS 2,996,150 A * 8/1961 Cassem ..... 184/106
4,807,921 A * 2/1989 Champie et al. ..... 160/235

* cited by examiner

*Primary Examiner*—Mark T. Le
(74) *Attorney, Agent, or Firm*—Thompson & Knight, L.L.P.

(57) ABSTRACT

A moveable track cover is provided for use with a mechanism configured to move along a track. One example of such a mechanism is a pipe racking system used on off-shore oil and gas platforms. One end of the moveable track cover is connected to the pipe racking system mechanism which moves along the track. The other end of the track cover is spooled onto a drum. Rotation of the drum is controlled by a motor which exerts enough force to maintain the track cover in constant tension. When the pipe racking system mechanism moves towards the drum, the motor rotates the drum to roll the track cover onto the drum. When the pipe racking system mechanism moves away from the drum, it pulls the track cover off of the drum. By attaching a track cover to each side of the pipe racking system mechanism, the track along which the pipe racking system mechanism travels is kept covered at all times. The track cover may be constructed of a sheet of stainless steel strengthened by rib assemblies. The rib assemblies may include wear strips to facilitate easy sliding of the track cover, and the top of the sheet will preferably have a non-skid material adhered to it to prevent workers from slipping on the sheet when they are walking across it.

13 Claims, 2 Drawing Sheets

PIPE RACKING SYSTEM TRACK OVER

CROSS-REFERENCE

The present nonprovisional application is a divisional of and claims the benefit of the prior filed copending nonprovisional application entitled PIPE RACKING SYSTEM TRACK COVER; filed Nov. 15, 1999; and identified by application Ser. No. 09/440,629, now U.S. Pat. No. 6,341,565. The present nonprovisional application incorporates that parent application to the full extent allowable by law.

FIELD OF THE INVENTION

The present invention relates generally to safety devices for covering hazards and, more particularly, to moveable covers for covering open tracks.

BACKGROUND OF THE INVENTION

Drilling oil and gas wells has always been a hazardous undertaking. Workers on offshore drilling platforms must contend with harsh environmental conditions, extremely large and heavy equipment, and unpredictable geologic formations. To contend with these hazards, numerous advancements in safety have been made.

Perhaps one of the most important safety advances in offshore drilling has been the utilization of automated equipment and robotics to perform some of the work previously performed by people. Rising labor costs and a renewed emphasis on personnel safety have made the cost of automation more palatable to drilling companies. As a result, advances in automation are being incorporated into offshore drilling operations faster than ever before.

However, along with these advances in automation have come new hazards. Consider, for example, automated pipe racking systems. Traditionally, rig-hands were required to physically move drill pipe from a stored position near a well bore and connect the drill pipe together before lowering it into the well. With the advent of automated pipe racking system (PRS) technology, rig-hands are no longer required to manually wrestle the drill pipe into position. Instead, an equipment operator in an environmentally controlled enclosure controls robotic equipment to perform many of the tasks formerly carried out by rig-hands.

The operation of a pipe racking systems requires that a PRS mechanism be able to move across the drill floor from where the pipe is racked, or stored, to the rotary table where the drill pipe is made up (connected) and then lowered into the well bore. To allow movement of the PRS mechanism, a track is run along the course that the PRS mechanism will follow. In practice, this track is generally about four inches across and approximately one foot deep, with gears inside to move the PRS mechanism.

While PRSs have the potential to greatly increase worker safety by limiting worker exposure to a variety of hazards, the PRS track creates its own hazards. It has been found that when the PRS mechanism is not in use, the track required for its movement causes a significant tripping hazard. During the course of day to day operations, rig-hands are frequently required to cross the PRS track. While doing so it is not uncommon for rig-hands to step in the track and twist their ankles. The possibility of dropping small objects in the track, thereby impeding the movement of the PRS mechanism, has also been noted.

Covering the track during long periods of non-use with a standard, immobile cover could provide a partial solution to the tripping and dropped equipment hazards. However, use of a non-moveable cover would be impractical. Firstly, the cover would have to be frequently installed and uninstalled, because the PRS mechanism can not move along the track with a non-moveable cover in place. Therefore, a non-moveable cover would provide no protection when the PRS is in use. Secondly, if rig-hands forget to install the cover over the track, or elect not to install the cover for short periods of time, the purpose of the track cover would be defeated.

What is needed therefore, is a track cover that moves in response to the PRS equipment movement to ensure that the PRS track remains covered during periods of both operation and non-operation.

SUMMARY OF THE INVENTION

Accordingly, the present invention provides a track cover for use with a mechanism configured to move along a track in a floor on an off-shore drilling platform. The track cover comprises a sheet moveably positioned over the track. This sheet is configured to be rolled and unrolled in response to the mechanism's position.

The present invention also provides a track covering system comprising a track, a mechanism configured to move along the track, at least one track cover, a drum, and a motor. The drum is configured to receive the track cover, and the motor is configured to rotate the drum in response to the mechanism's position along the track.

The present invention further provides a method for covering a track. The method comprises covering the track with a moveable track cover, and moving the track cover in response to movement of a device along the track.

An object of the present invention is to provide a moveable track cover system that keeps a track continuously covered, regardless of the position of a mechanism moving along the track.

An advantage of the present invention is that the track cover helps prevent workers from inadvertently stepping in or tripping over the track.

A further advantage of the present invention is that the track cover prevents objects from being inadvertently dropped into the track.

Another advantage of the present invention is that it provides a non-skid surface that supports workers while walking over the track.

An additional advantage of the present invention is that the track cover does not adversely affect worker efficiency by requiring repeated installation and removal.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION PREFERRED EMBODIMENT

Figure 1:
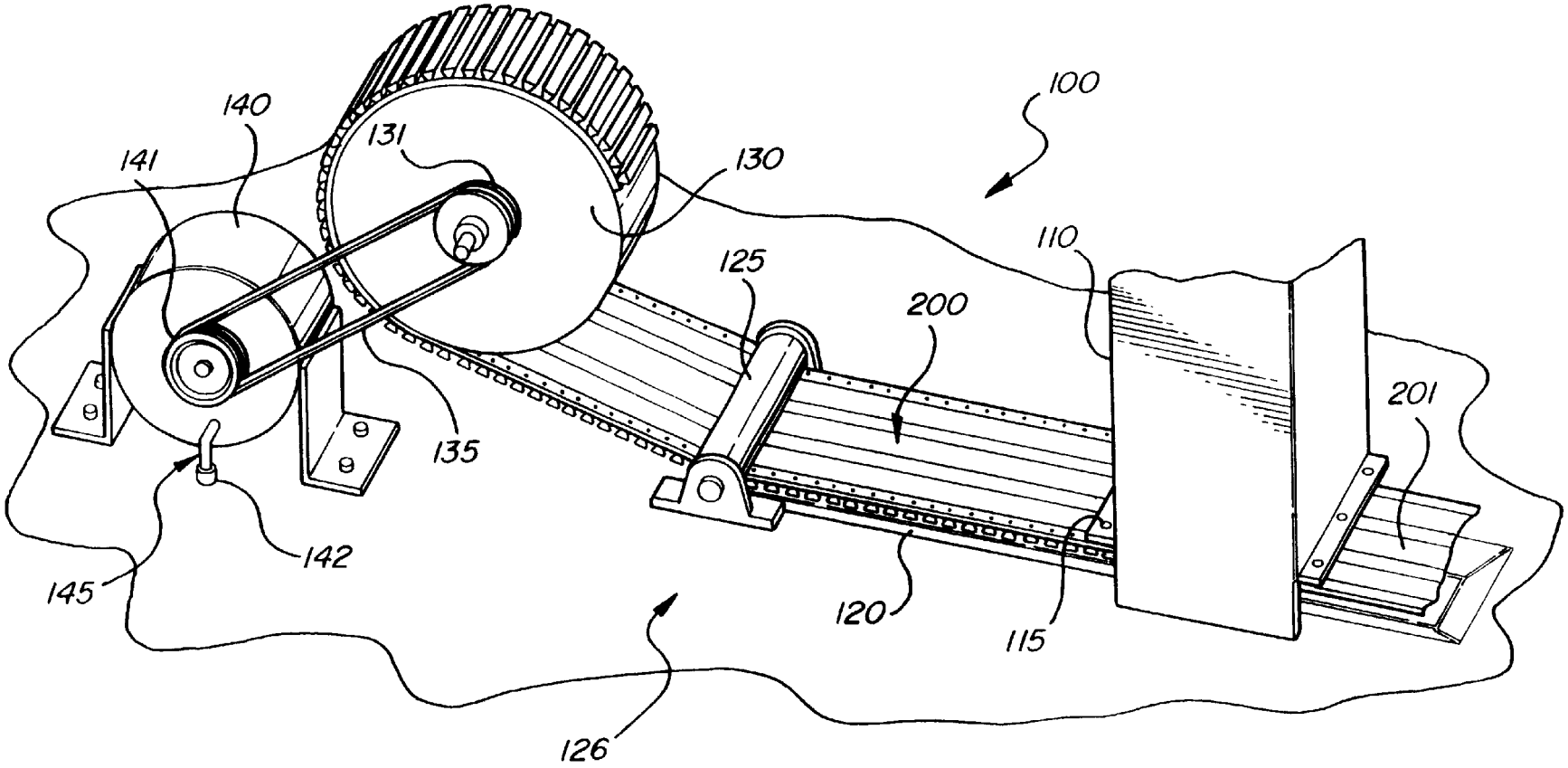
FIG. 1 a perspective view of a pipe rack system track cover system according to a preferred embodiment of the present invention.

Referring first to FIG. 1, a pipe racking system (PRS) track cover system is illustrated, and designated generally by reference numeral 100. In a preferred embodiment of the present invention, PRS track cover system 100 includes PRS mechanism 110, track 120, track cover 200, roller guide 125, drum 130, chain 135, motor 140, bypass valve 142, and air inlet 145.

PRS mechanism 110 is configured to move back and forth along track 120, which appears in the floor 126 of conventional off-shore drilling platforms. Track 120 is used to facilitate movement of PRS mechanism 110 as it transfers drill pipe from a stored position to the well bore, in preparation for running the drill pipe into the well. In a preferred embodiment of the present invention, one end of track cover 200 is fastened to PRS mechanism 110 using bolts 115. As PRS mechanism 110 moves away from drum 130, track cover 200 is pulled along with it, thereby keeping track 120 covered. The opposite end of track cover 200 (the end not connected to PRS mechanism 110) is connected to drum 130. When track cover 200 is rolled onto or unrolled off of drum 130, the track cover passes under roller-guide 125 to maintain proper positioning of track cover 200 over track 120.

Preferably, drum 130 is driven by motor 140 using suitable means, such as by axially mounted sprockets 131 and 141 interconnected by chain 135. (Individual sprocket teeth and chain links are not shown for ease of illustration, but are conventional and well known in the art.) Motor 140 applies a continuous rotational force to drum 130 via chain 135, thereby maintaining tension on track cover 200. The force exerted by motor 140 on drum 130 is sufficient to roll track cover 200 onto drum 130 when PRS mechanism 110 moves towards drum 130. Bypass valve 142 is configured to limit the force delivered by motor 140 to drum 130, such that when PRS mechanism 110 moves away from drum 130, the force exerted on track cover 200 is sufficient to unroll track cover 200 off of drum 130.

In a preferred embodiment of the present invention, air is supplied to operate motor 140 via air inlet 145, in accordance with conventional pneumatic drive systems. A preferred value of air pressure supplied through air inlet 145 is approximately 35 psi. Other operating air pressure values may also be suitable, as will be recognized by those skilled in the art. In practice, any value of air pressure that causes PRS track cover system 100 to operate as described above, can be used.

Drum 130 is preferably approximately 12 inches in diameter. As with the operating pressure, the exact diameter of drum 130 is not critical, and one skilled in the art could choose any convenient drum diameter consistent with the objectives described herein.

Although not illustrated in FIG. 1, a safety enclosure should be placed around motor 140, chain 135 and drum 130, but a description of the safety enclosure is not necessary for understanding the basic structure and operation of the invention. A second track cover 201, is partially shown. Second track cover 201 is attached to the side of PRS mechanism 110 opposite track cover 200. Preferably, second track cover 201 has associated equipment (not illustrated) including a drum, a motor, a roller guide, etc., which may be similar to the corresponding components shown in FIG. 1. Second track cover 201 and its associated equipment function in the same manner as track cover 200 and its associated equipment, as described in the previous paragraphs.

Figure 2:
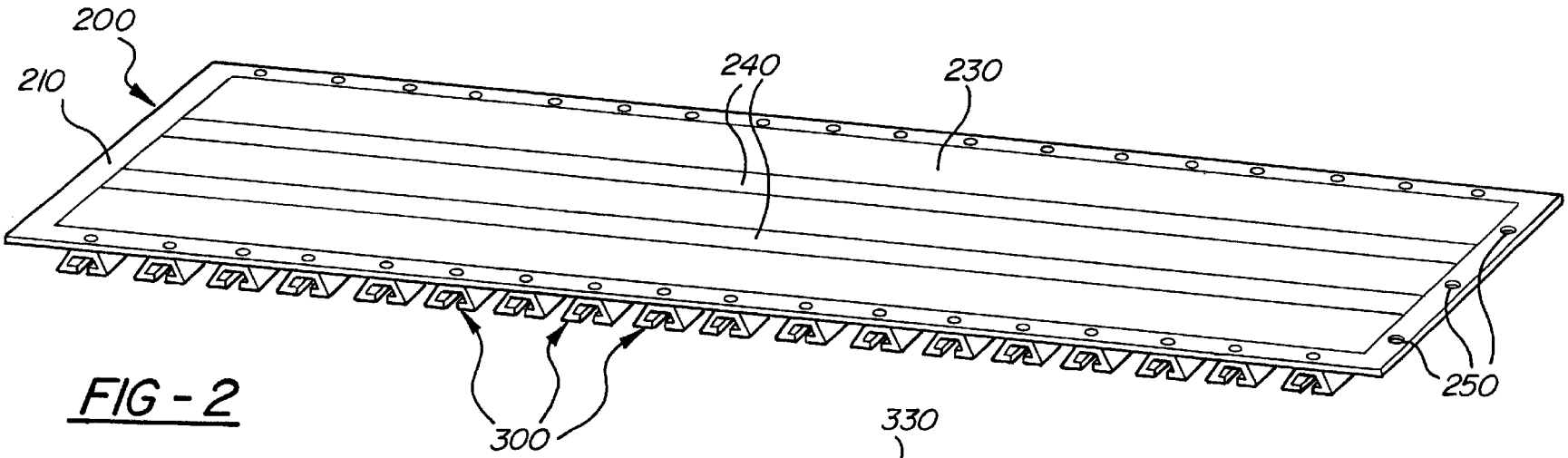
FIG. 2 is a perspective view of a track cover according to a preferred embodiment of the present invention.

FIG. 2 shows more details of the preferred track cover 200. Track cover 200 includes sheet 210, rivets 220, rib assemblies 300, non-skid material 230, reflective stripes 240, and bolt holes 250.

In an embodiment of the invention currently in use, sheet 210 is constructed of stainless steel and is approximately 12 inches wide by 35 feet long. Constructing sheet 210 of stainless steel provides the flexibility needed to roll and unroll track cover 200 on to and off of drum 130, while still providing sufficient strength to allow workers to walk on track cover 200. The exact type of material used to construct sheet 210 is not critical; other materials such as various rubbers or plastics could conceivably be used by one skilled in the art to practice the present invention.

The ends of the rib assemblies 300 may be riveted to sheet 210 using suitable rivets 220, which preferably are structurally solid rivets that add strength and ruggedness. As an alternative (or in addition) to rivets 220, rib assemblies 300 may be secured to sheet 210 using a suitable adhesive material. Other embodiments exist in which sheet 210 and rib assemblies 300 are formed from a single piece of material. Additionally, it will be appreciated that other fastening methods can be used to fasten rib assemblies 300 to sheet 210.

A non-skid material 230 can be applied to the walking surface of sheet 210. Since it is preferred to construct sheet 210 of stainless steel, non-skid material 230 is a desirable safety feature for preventing workers from slipping while walking on track cover 200. In other embodiments, where sheet 210 is formed of material that is not slippery, non-skid material 230 may not be needed. It is preferred that non-skid material 230 be a commercially available anti-skid tape, but could be another non-skid material, including spray on coatings.

As an additional safety feature, reflective stripes 240 can be included to aid workers in visually identifying track cover 200. Bolt holes 250 are provided for fastening track cover 200 to PRS mechanism 110 as illustrated in FIG. 1.

Figure 3:
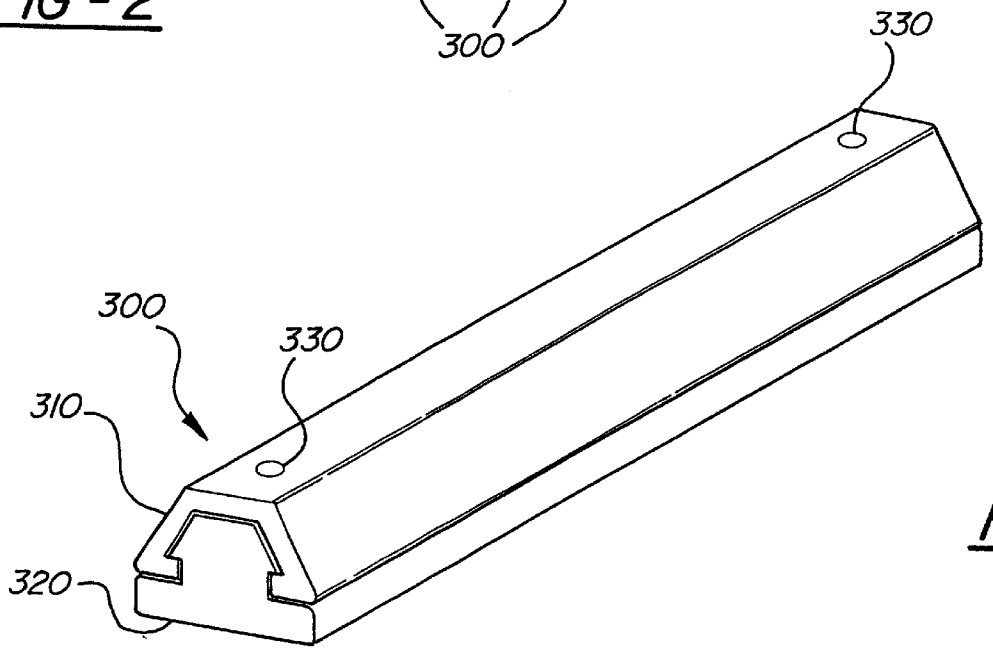
FIG. 3 is a perspective view of a rib assembly according to a preferred embodiment of the present invention.

A preferred rib assembly 300, which is shown in FIG. 3, is constructed of a rigid support rib 310 and wear strip 320, which may be a suitable hard rubber material. Rivet holes 330 are used to fasten rib assembly 300 to sheet 210, as illustrated in FIG. 2. Support rib 310 may be constructed of aluminum, and preferably includes a generally u-shaped channel running from end to end. Wear strip 320 and support rib to 310, may be interlocked in a tongue-and-groove manner as shown, with wear strip 320 preferably extending approximately ⅛th of an inch below support rib 310. Wear strip 320 may be impregnated with molybdenum disulfide to reduce the sliding friction of track cover 200. Alternatively, the rib assemblies 300 may be constructed of a one-piece rubber or durable plastic material, or may be made of Teflon coated metals, or other materials known by those skilled in the art to provide reduced friction and/or wear protection.

Although an embodiment of the present invention has been shown and described in detail herein, along with certain variations thereof, those skilled in the art, upon reading the foregoing, will recognize that other modifications can be made, and alternatives and equivalents substituted, within the spirit and scope of the invention as set forth in the appended claims.

What is claimed is:

1. A track cover attached to an equipment, configured to move along a track in a floor of an off-shore drilling platform, comprising:

a sheet movably positioned over said track;

said sheet having a top surface and a bottom surface;

said sheet being configured to be rolled and unrolled in response to said equipment's position;

ribs on said bottom surface of said sheet; and friction reducing material attached to said ribs.

2. A track cover attach to an equipment configured to move along a track in a floor of an off-shore drilling platform, comprising:

a sheet movably positioned over said track;

said sheet having a top space and a bottom surface;

said sheet being configured to be rolled and unrolled in response to said equipment position; and a non-skid material adhered to said top surface.

3. A track cover attached to an equipment configured to move along a track in a floor of an off-shore drilling platform, comprising:

a sheet movably positioned over said track;

said sheet having a top surface and a bottom surface;

said sheet being configured to be rolled and unrolled in response to said equipment position; and wherein said sheet is constructed of a non-skid material wherein said non-skid material is less slippery than aluminum.

4. A track cover of an off-shore drilling system's equipment track, wherein said track cover is adapted to cover at least a portion of said track having a width, said track cover is adapted to being attached to, an equipment configured to move along the track, such that the track cover is configured to move along the track with the equipment;

said track cover is adapted to span across an entire width of the track;

said track cover being adapted to be received by a drum configured to receive said track cover, such tat a motor operably coupled to the drum so as to rotate the drum in response to the mechanism's position along the track would cause said track cover to move.

5. The track cover of claim 4, configured to operably cooperate with drums, motors and at least another track cover.

6. The track cover of claim 4, wherein said track cover has a first end and a second end such that the first end of said track cover is connected to the equipment and the second end of said track cover is connected to the drum.

7. The track cover of claim 6, wherein said track cover is adapted to be rolled onto the drum when the equipment moves towards the drum by the motor being configured to provide sufficient rotational force to the drum;

wherein said track cover is adapted to unroll off of the drum in response to the equipment pulling as the equipment moves away from the drum, the unrolling being allowed by a tension limiter that is operably coupled to the motor.

8. The track cover of claim 7, wherein the tension limiter is a bypass valve.

9. The track cover of claim 4, wherein the motor is operably coupled to the drum by a chain connecting a first pulley on the motor and a second pulley on the drum.

10. The track cover of claim 4, adapted to be positioned by a guide roller.

11. The track cover of claim 4, wherein the motor and the drum are adapted to be at least partially covered by an enclosure.

12. The track cover of claim 4, wherein the equipment is a pipe racking system.

13. The track cover of claim 4, wherein the motor is operated by air pressure.

* * * * *

UNITED STATES PATENT AND TRADEMARK OFFICE

CERTIFICATE OF CORRECTION

PATENT NO. : 6,427,603 B1
DATED : August 6, 2002
INVENTOR(S) : Therald Martin

It is certified that error appears in the above-identified patent and that said Letters Patent is hereby corrected as shown below:

Column 5,
Line 6, add -- ed -- to the word "attach" to read -- attached --.
Line 37, delete the word "tat" and insert in its place the word -- that --;

Column 6,
Line 2, delete the word "mechanism" and insert in its place the word -- equipment --.

Signed and Sealed this

Twenty-ninth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,427,603 B1
DATED : August 6, 2002
INVENTOR(S) : Therald Martin

It is certified that error appears in the above-identified patent and that said Letters Patent is hereby corrected as shown below:

Title page, Item [54] and Column 1, line 1,
Title should read -- PIPE RACKING SYSTEM TRACK COVER --.

Signed and Sealed this

First Day of July, 2003

JAMES E. ROGAN
*Director of the United States Patent and Trademark Office*